United States Patent [19]

Blackmon

[11] 4,214,748

[45] Jul. 29, 1980

[54] SPRING-BIASED EXERCISE APPARATUS

[75] Inventor: Charles V. Blackmon, Wichita, Kans.

[73] Assignee: Blackmon Enterprises, Inc., Wichita, Kans.

[21] Appl. No.: 931,559

[22] Filed: Aug. 7, 1978

[51] Int. Cl.[2] ..... A63B 5/00

[52] U.S. Cl. ..... 272/67; 272/142; 272/143; 272/136; 272/DIG. 4

[58] Field of Search ..... 272/136, 142, 144, DIG. 4, 272/67, 68, 134, 135, 130, 143; 188/266; 267/73, 74; 16/84, 85

[56] References Cited

U.S. PATENT DOCUMENTS

| | | | |
|---|---|---|---|
| 2,782,033 | 2/1957 | Ugartechea | 272/136 |
| 3,558,131 | 1/1971 | Dragon | 272/142 X |
| 3,559,487 | 2/1971 | Parlato | 272/67 X |
| 3,633,907 | 1/1972 | Cane | 272/67 X |
| 3,662,602 | 5/1972 | Weiss | 272/142 X |
| 3,815,904 | 6/1974 | Weiss | 272/136 |
| 3,982,757 | 9/1976 | McDonnell | 272/134 |
| 4,063,727 | 12/1977 | Hall | 272/136 |
| 4,129,297 | 12/1978 | Dolan | 272/142 X |

*Primary Examiner*—William R. Browne
*Attorney, Agent, or Firm*—John H. Widdowson

[57] ABSTRACT

The exercise apparatus has a base. A generally U-shaped upright member has the base thereof pivotally connected to the base of the exerciser. An essentially U-shaped bolt is attached at the outer end portions of its arms to the U-shaped upright member. A spring or springs acting in tension is attached to the bolt and to the base of the exerciser.

7 Claims, 4 Drawing Figures

FIG. 1
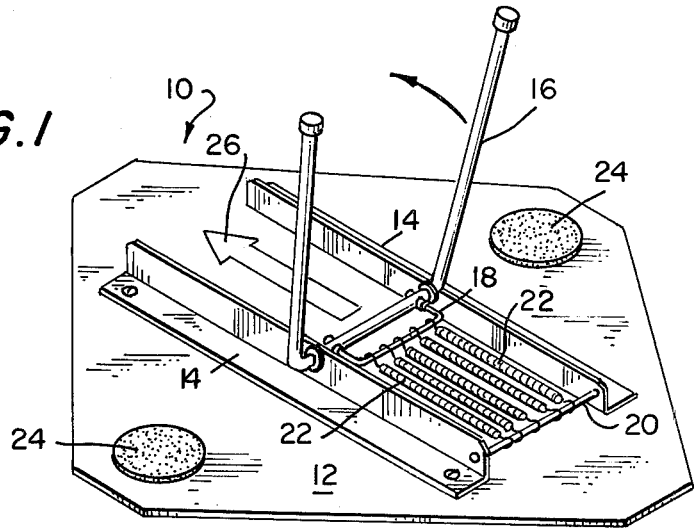
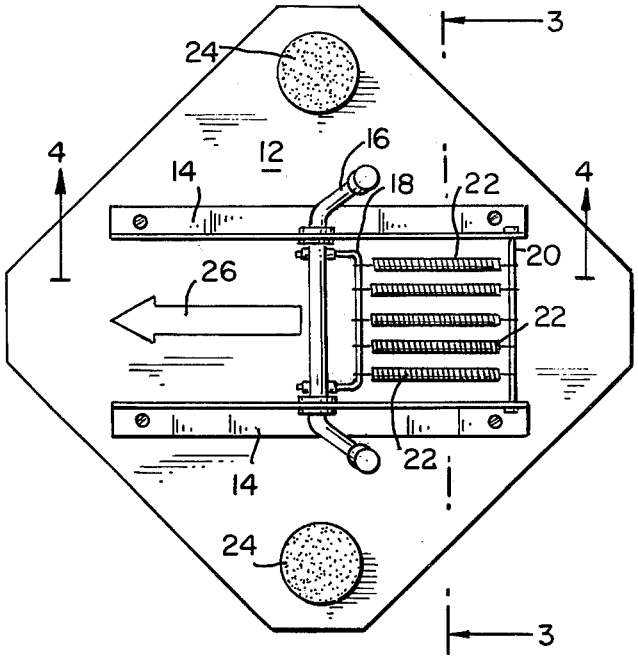
FIG. 2
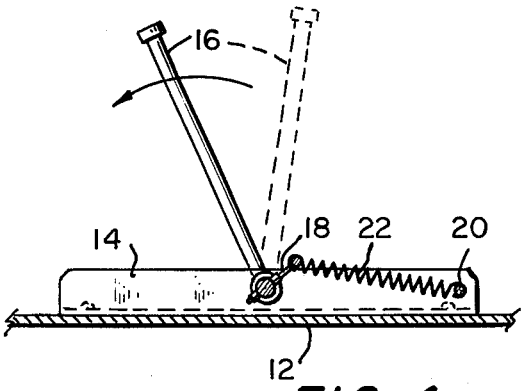
FIG. 4
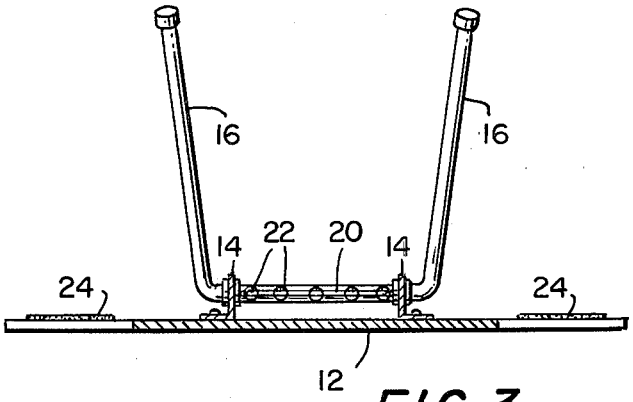
FIG. 3

SPRING-BIASED EXERCISE APPARATUS

BACKGROUND OF THE INVENTION

1. Field of the Invention

This invention relates to an arm exercise device. More particularly this invention provides an arm wrestling exercise device.

2. Description of the Prior Art

U.S. Pat. No. 2,782,033 by E. Ugartechea, Feb. 19, 1957, discloses a pivoted U-shaped upright. Springs connect between a cross member on top of same to a base support. The upright and base support are not portable but are fixed to a table or the like. U.S. Pat. No. 4,063,727 by J. A. Hall, Dec. 20, 1977, discloses an arm wrestling device with the appearance of an arm and hand. U.S. Pat. No. 3,559,487 by F. Parlato, Feb. 2, 1971, discloses an Indian arm wrestling device. U.S. Pat. 3,982,757 by R. J. McDonnell, Sept. 28, 1976, and U.S. Pat. No. 3,815,904 by Weiss et al, June 11, 1974, discloses a torsion type arm exercise apparatus and a spring-type exercising device, respectively. None of the prior art teach or suggest the arm exercise device of this invention.

SUMMARY OF THE INVENTION

It is therefore an object of this invention to provide an arm exercise device.

It is another object of this invention to provide an arm wrestling exercise device.

Still other objects will be apparent to those skilled in the art from the following description of this invention.

The foregoing objects are achieved according to the practice of this invention. Broadly, this invention comprises a base; a generally U-shaped rod member having its base pivotally connected to the base; an essentially U-shaped bolt member whose arms are attached to the U-shaped rod member; spring bias means attaching to the U-shaped bolt member and to the base such that when the U-shaped rod member pivots away from the spring bias means and against the tension of the spring bias means, tension is put on the U-shaped pivot member without having the spring bias means stretch over at least one of the arms of the U-shaped rod member and creating a safety hazard.

These objects together with various ancillary objects and features which will become apparent to those artisans possessing ordinary skill in the art and as the following description proceeds are attained by this novel arm exercise device, a preferred embodiment shown in the accompanying drawings, by way of example only wherein:

BRIEF DESCRIPTION OF THE DRAWINGS

FIG. 1 is a perspective view of the arm exercise device;

FIG. 2 is a top plane view of the arm exercise device;

FIG. 3 is a vertical sectional view taken along the line 3—3 in FIG. 2; and FIG. 4 is a vertical sectional view taken along the line 4—4 in FIG. 2.

DETAILED DESCRIPTION OF THE INVENTION

With continuing reference to the drawings, wherein similar parts are represented by identical reference numerals, there is seen a portable arm exercise device, generally represented as 10, having a base 12, a pair of angle iron guide members 14 connected to said base 12 in a parallel relationship, and a generally U-shaped tube or rod member 16 having its base pivotally lodging in each L-shaped guide member 14. An essentially U-shaped bolt member 18 has arms attaching to the U-shaped rod member 16. As evidenced in FIG. 4, the plane of the U-shaped bolt member 18 is disposed at an angle preferably less than 90° with the plane of the U-shaped rod member 16. A spring means connection rod 20 connects with the two guide members 14, and a plurality of hook-attached, easily mountable and detachable coil springs 22 connects with the rod 20 and the U-shaped bolt member 18 such that when the U-shaped rod member 16 pivots away from the spring coils 22 and against the tension of the coils 22, tension is put on the U-shaped rod member 16. Springs 22 preferably have the hooks shown in the drawings at the bolt member 18 to provide for easy connection so as to provide for easy adjustment of the number of springs and their tension. Springs 22 are preferably attached to rod 20 so that they are not easily removed or become disattached, to provide for reliable portability. Elbow support pads 24 attach to the base 12 and arrow 26 is labeled on the base 12.

With continual reference to the drawings for operation of the invention, user of the arm wrestling exercise device places his elbow on pad 24 and grasps U-shaped tube member 16 and, keeping the elbow always on pad 24, moves the rod member 16 from its normal upright position through its full arc in the direction the arrow 26 points until it comes to a stop against the base 12. Repetition of this exercise enables the user to build strength in the arms.

While the foregoing description is a presentation of the invention, it will be understood that the scope of the invention is limited only by the appended claims.

I claim:

1. An exercise device comprising a base; a generally U-shaped member having arms and a base pivotally connected to the base of the device; a U-shaped bolt means having spaced arms fixedly attached directly to the base of the U-shaped member; a plane including the spaced arms of the U-shaped bolt member forming an angle of less than 90° with a plane passing through the arms of the U-shaped member; spring bias means attached to the bight portion of the U-shaped bolt member and to the base of the device so that when said U-shaped member pivots away from said spring bias means and against the tension of the spring bias means, tension is put on said U-shaped member without having the spring bias means stretch over at least one of the arms of said U-shaped member and creating a safety hazard; the arms of said U-shaped bolt member being offset from the arms of the U-shaped member along the longitudinal axis of the base of the U-shaped member.

2. The device of claim 1 additionally including at least one guide member attached to said base of the device wherein said U-shaped member pivotally lodges.

3. The device of claim 2 having two guide members connected to said base of the device essentially in a parallel relationship, the base of said U-shaped member pivotally lodges in each guide member.

4. The devide of claim 3 additionally including a spring means connection rod which connects with the two guide members on the U-shaped bolt member side of said U-shaped member when the last mentioned member is substantially vertical, said spring bias means connects with said spring means connection rod.

5. The device of claim 4 wherein said spring bias means comprises a plurality of coil springs.

6. The device of claim 5 wherein said guide members are angle iron members.

7. The device of claim 6 wherein said device including said base is portable.

* * * * *